US006588791B1

(12) United States Patent
Horn

(10) Patent No.: US 6,588,791 B1
(45) Date of Patent: Jul. 8, 2003

(54) SAFETY BINDING FOR SKI BOOT

(75) Inventor: Hans-Johann Horn, Bern (CH)

(73) Assignee: Look Fixations S.A., Nevers (FR)

( * ) Notice: Subject to any disclaimer, the term of this patent is extended or adjusted under 35 U.S.C. 154(b) by 0 days.

(21) Appl. No.: 09/856,091

(22) PCT Filed: Nov. 16, 1999

(86) PCT No.: PCT/IB99/01840

§ 371 (c)(1),
(2), (4) Date: May 16, 2001

(87) PCT Pub. No.: WO00/29078

PCT Pub. Date: May 25, 2000

(30) Foreign Application Priority Data

Nov. 16, 1998 (CH) ..... 2287/98

(51) Int. Cl.[7] ..... A63C 9/085
(52) U.S. Cl. ..... 280/613; 280/626; 280/634
(58) Field of Search ..... 280/607, 842, 280/11.31, 613, 614, 623, 624, 625, 626, 628, 633, 634, 635, 617, 618, 627

(56) References Cited

U.S. PATENT DOCUMENTS

| | | | | | |
|---|---|---|---|---|---|
| 3,897,958 | A | * | 8/1975 | Sentou | 280/625 |
| 4,062,563 | A | * | 12/1977 | Manfreda | 280/625 |
| 4,078,828 | A | * | 3/1978 | Salomon | 280/625 |
| 4,082,314 | A | * | 4/1978 | Sedlmair | 280/625 |
| 4,088,343 | A | * | 5/1978 | Krob | 280/625 |
| 4,190,264 | A | | 2/1980 | Himmetsberger | |
| 4,288,094 | A | * | 9/1981 | Svoboda | 280/623 |
| 4,336,956 | A | * | 6/1982 | Richert et al. | 280/625 |
| 4,372,574 | A | * | 2/1983 | Svoboda et al. | 280/625 |
| 4,401,318 | A | | 8/1983 | Beyl | |
| 4,434,997 | A | * | 3/1984 | Nitschko | 280/625 |
| 4,765,641 | A | | 8/1988 | Peyre | |
| 4,858,946 | A | * | 8/1989 | Stritzl et al. | 280/618 |
| 4,889,359 | A | | 12/1989 | Kowatsch | |
| 4,979,762 | A | * | 12/1990 | Gallet | 280/625 |
| 5,040,821 | A | * | 8/1991 | Berthet et al. | 280/625 |
| 5,050,903 | A | * | 9/1991 | Stritzl et al. | 280/625 |
| 5,193,841 | A | * | 3/1993 | Stritzl et al. | 280/625 |
| 5,222,756 | A | * | 6/1993 | Gorza | 280/616 |
| 5,890,731 | A | * | 4/1999 | Challande et al. | 280/625 |
| 6,092,831 | A | * | 7/2000 | Bauvois | 280/625 |

FOREIGN PATENT DOCUMENTS

| | | |
|---|---|---|
| CH | 686 707 A | 6/1996 |
| DE | 26 03 010 A | 8/1977 |
| DE | 27 56 995 | 12/1977 |
| FR | 2 758 732 | 1/1997 |

OTHER PUBLICATIONS

International Search Report In PCT/IB 99/01840.

* cited by examiner

*Primary Examiner*—Paul N. Dickson
*Assistant Examiner*—Laura B. Rosenberg
(74) *Attorney, Agent, or Firm*—Bugnion S.A.; John Moetteli

(57) ABSTRACT

A safety binding for a ski boot having a sole clamp divided into two sole clamps (3, 4) each mounted pivoting about a particular more or less vertical axis. The sole clamps (3, 4) form two levers of a first type with two diverging arms designed to retain the boot laterally and two substantially converging arms perpendicular to the longitudinal axis. Each sole clamp is provided with a descending arm (9, 10) which bears against two adjacent points on the end of a piston (13). The piston is axially mounted in the body (1) of the binding and extends beneath the boot. A spring is biased against the piston. The descending arms (9, 10) simultaneously control the elastic tilting of the sole clamp in a vertical plane.

19 Claims, 14 Drawing Sheets

Fig.17
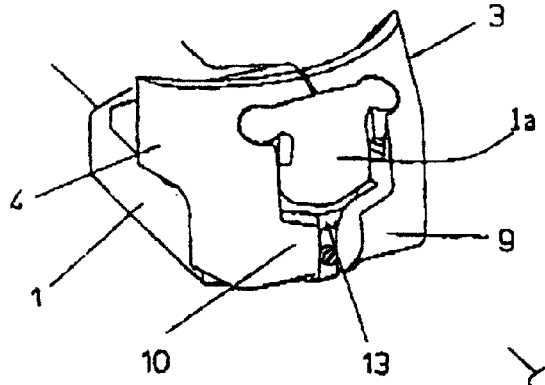
Fig.18
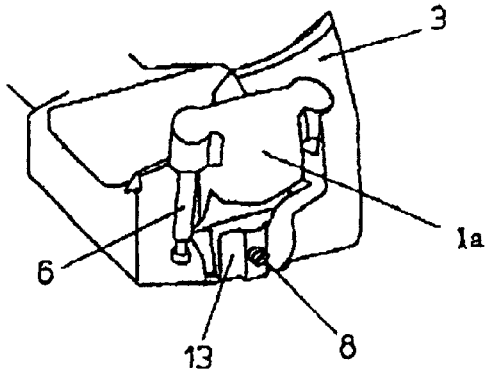
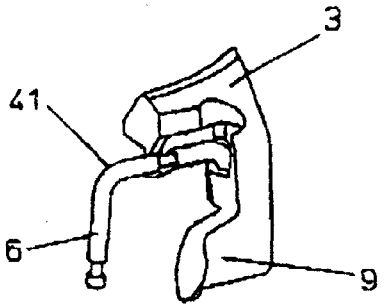
Fig.19
Fig.20
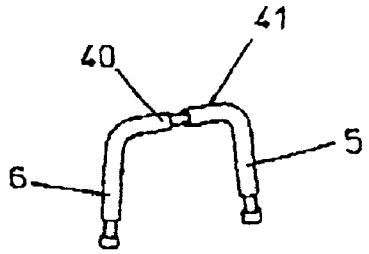

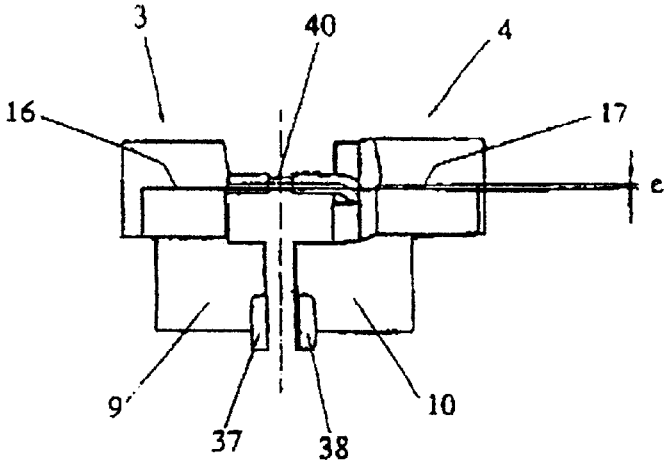
Fig.23
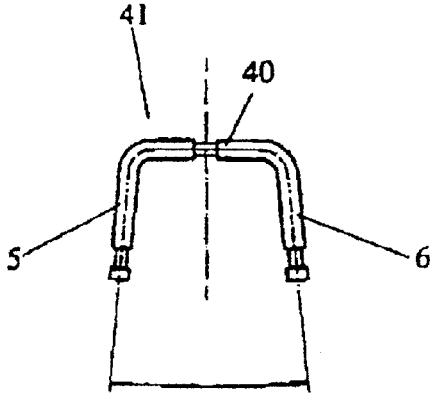
Fig.25
Fig.24
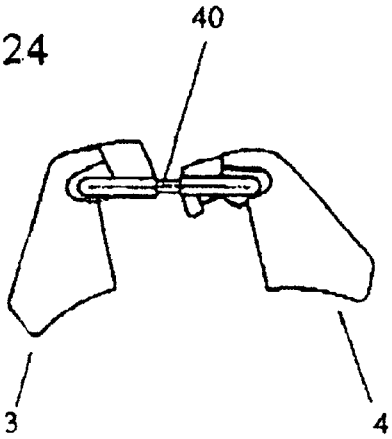

Fig 29
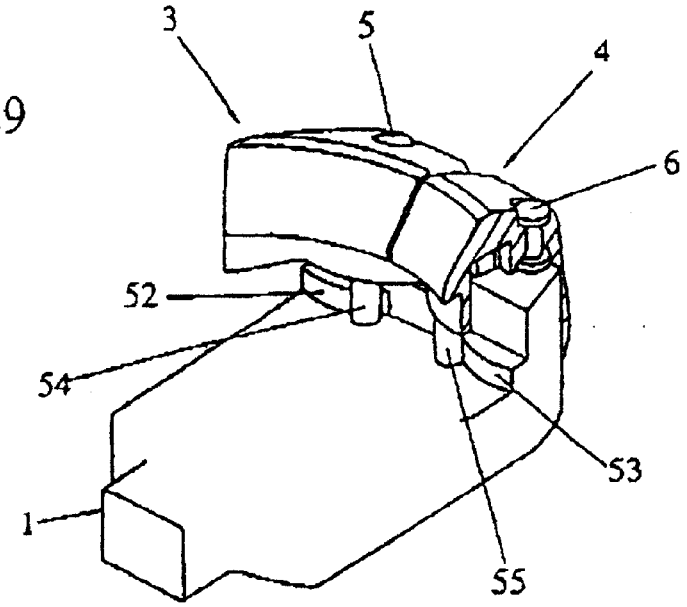
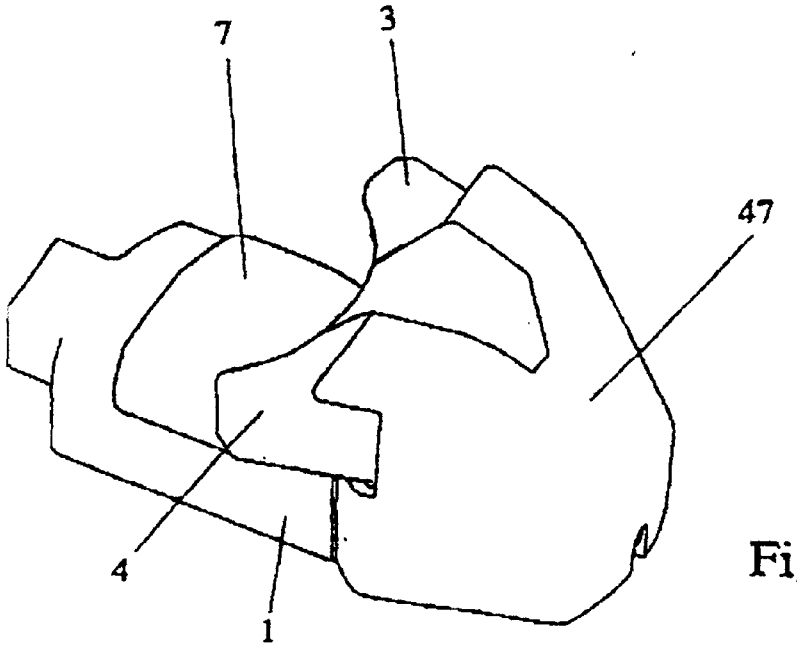
Fig.30

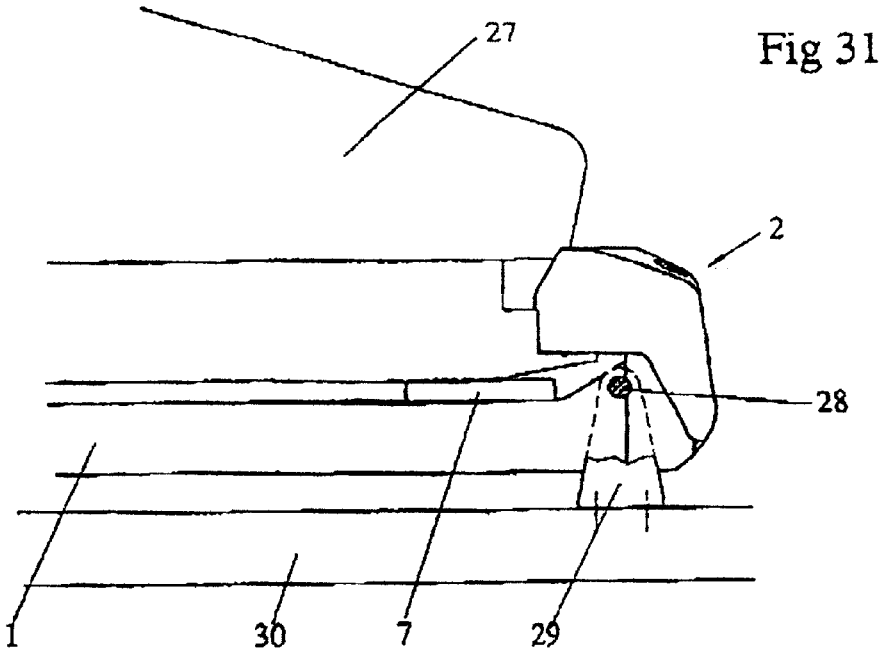
Fig 31
Fig 32
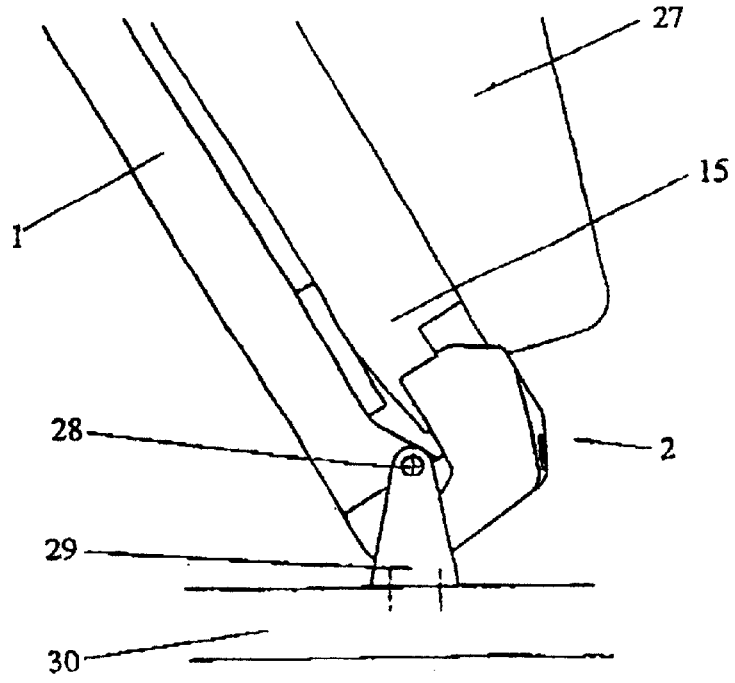

SAFETY BINDING FOR SKI BOOT

BACKGROUND OF THE INVENTION

A subject of the present invention is a safety binding for a ski boot, of which the sole has a curb comprising a binding body of which a horizontal part for the boot to rest on vertically and extending under the boot, contains an axially moving element urged by an elastic means, the body carrying a sole clamp for holding the boot by its curb, this sole clamp being mounted to pivot about at least one at least approximately vertical axle and pivoting through a limited angle in a vertical plane about a real or imaginary axis located in the region where the boot is held by the sole clamp, this sole clamp being equipped with two descending arms rigidly connected to the sole clamp and the ends of which bear against said moving element.

The invention is as applicable to a front stop as it is to a heel piece. The term "sole clamp" is to be understood as meaning a part of the binding which comes onto the curb of the boot via at least one face. All indications regarding direction are given relative to the tipper face of a horizontally positioned ski.

Such a binding is known, in the form of a stop, from patent CH 686 707. This binding has the advantage that just one spring can be used to control both the pivoting of the sole clamp about a vertical axle in the event of a fall and the tilting of the sole clamp in a vertical plane, whether this be in order to maintain a certain vertical pressure on the curb of the boot and to ensure that the height of the sole clamp elastically follows the variations in height that are encountered in standardized curbs or which are due to the presence of a wedge of snow on the binding or under the boot or alternatively in order to make the boot release more readily, particularly in the event of a fall forward. This possibility of tilting allows far better control of the release of the boot in a backward fall. Furthermore, arranging the spring and the piston under the surface on which the boot rests on the binding makes it possible to obtain a good relationship between the resistive torques exerted on the boot in the horizontal plane and in the vertical plane. More specifically, the active lever arms are of the same order of magnitude.

In a binding stop it is of prime importance for the sole clamp to have a good ability to return to its initial position. In particular, it is essential that in the event of a series of lateral knocks against the boot, as often occurs, especially in competition, this series of knocks should not result in a summation of small shifts of the sole clamp liable to give rise to inadvertent release of the binding but in any case resulting in poor alignment of the boot relative to the axis of the ski as a result of incomplete return of the stop to its initial position, such a defect causing a fall through lack of control of the ski. It is therefore essential that after each of the lateral knocks, the sole clamp should return to its initial position and bring the boot back to the correct position. From this point of view, the binding described in patent CH 686 707 is not satisfactory. This is because if FIG. 2 of that document is studied, it can be seen that the thrust exerted by the sole clamp on the piston creates a significant torque on the piston in a horizontal plane, this torque causing reactive lateral pressures resulting in friction forces that oppose the sliding of the piston. Now, it is known that in a safety binding, control over friction is essential if you want the binding to release consistently for given loads.

SUMMARY OF THE INVENTION

The present invention sets out precisely to overcome the defects of the aforementioned stop.

The binding according to the invention is characterized in that the sole clamp is split into two independent sole clamps each mounted to pivot about its own at least approximately vertical axle, these sole clamps constituting two levers of the first kind having two divergent lever arms intended to retain the boot laterally and two converging arms at least approximately perpendicular to the longitudinal axis of the binding and bearing respectively against the end of the moving element via a descending arm at two closely spaced points.

As the two points at which the descending arms of the sole clamp bear are closely spaced, they are also close to the axis of the moving element. They will even advantageously be as close to this axis as possible. The torque exerted on the moving element by the sole clamp is thus very small, which means that the friction forces caused by this torque are insignificant.

Furthermore, the friction of the sole clamps on the curb of the boot are less than in a binding with a single sole clamp.

Furthermore, the fact of having two independent sole clamps encourages the sole clamps to recenter themselves and encourages escape from the binding in the event of a fall, as has already been explained in document EP 0 295 372. Front stops comprising two sole clamps are also known, particularly from document DE 27 56 995, EP 0 241 360, FR 2 464 727 or, more recently, document FR 2 758 732. In the bindings described in those documents, the spring is located at the front of the sole clamps, at the height thereof and acts on a tie rod to one end of which the arms of the sole clamps are attached. The kinematics of these stops is therefore very different than that of the binding according to the invention.

The moving element advantageously consists of a piston.

In order to have a harmonious relationship between the resistive torques of lateral retention and of tilting in a vertical plane, the distance between the imaginary axis of rotation of the sole clamps in a vertical plane and the end of points at which the descending arms bear on the piston is advantageously approximately equal to the length of the diverging lever arms of the arms of the sole clamps.

The limited tilting of the sole clamps in a vertical plane can be achieved in various ways.

In one embodiment, the pivot axles of the sole clamps about as approximately vertical axis have two axial stops retaining the sole clamps vertically and the sole clamps have, between these stops, forward angular clearance allowing the sole clamps to tilt to a limited extent.

In another embodiment, the pivot axles of the sole clamps about an approximately vertical axis are connected without clearance to the sole clamps and are connected together rigidly at their upper part by a horizontal part so as to form a single. U-shaped component mounted to pivot on the body, between two stops, about its horizontal part. The stops advantageously consist of the ends of two slots formed in the binding body and through which the pivot axles pass.

The branches of the U-shaped component advantageously diverge slightly so that the pivot axles are inclined slightly so that the path of the sole clamps, as they open, is slightly upward, which encourages the boot to escape because the sole clamp thus moves vertically away from the curb of the boot.

The amplitude of the tilting of the sole clamps in a vertical plane can be increased in order to release the boot in the event of a backward fall in the case of a front stop or to release the boot in a forward fall in the case of a heel piece.

In the case of a stop, as with the binding according to patent CH 686 807, the binding body of the stop may be articulated in a stirrup to produce a cross-country binding.

The appended drawing depicts, by way of example, a number of embodiments of the binding according to the invention.

BRIEF DESCRIPTION OF THE DRAWINGS

FIG. 17 is a frontal perspective view of a third embodiment.

FIG. 18 is a view similar to FIG. 17, but without the right-hand arm of the sole clamp.

FIG. 19 depicts, from the same perspective, the support of the sole clamp with one of the arms thereof.

FIG. 20 depicts the support of the sole clamp alone.

FIG. 23 is a view from the rear forward of the sole clamp alone, in which the sole clamp is away from its position of rest.

FIG. 24 is a front view of the support of the sole clamp according to FIGS. 19 and 20.

FIG. 25 is a view from above of the sole clamp as depicted in FIG. 23.

FIG. 29 is a perspective view of a variant of the embodiment according to FIGS. 11 to 13.

FIG. 30 is a perspective view of a stop according to the invention, covered with a protective cap.

FIG. 31 is a side view of a cross-country binding equipped with a stop according to the invention, in the downhill position.

FIG. 32 depicts the same cross-country binding in the walking position.

DETAILED DESCRIPTION OF THE PREFERRED EMBODIMENT(S)

Figure 1:
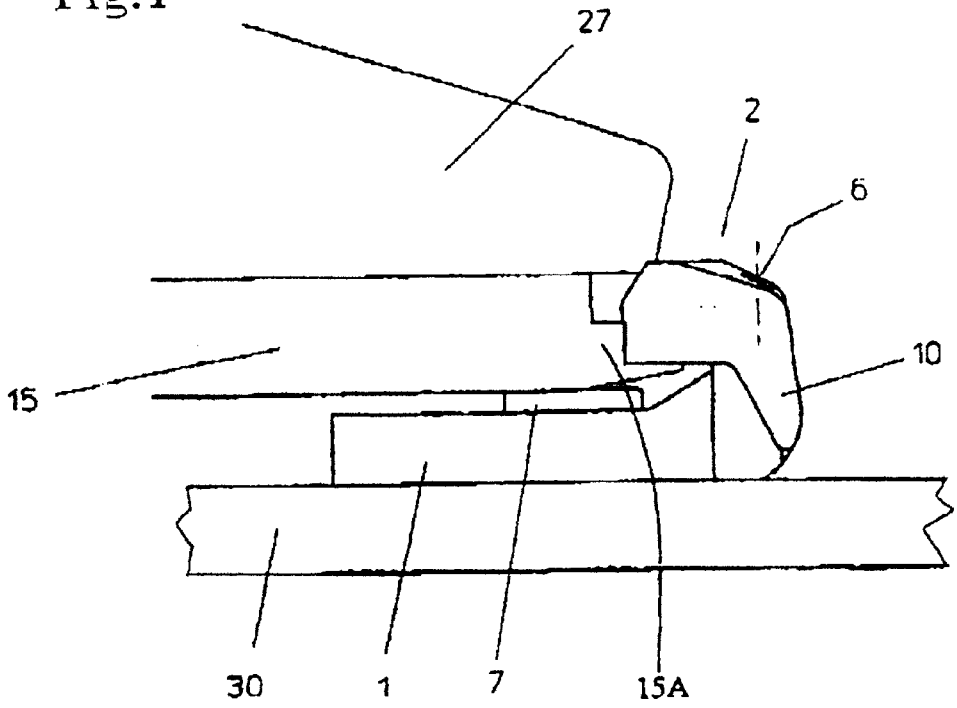
FIG. 1 is a side view of a stop according to a first embodiment.
Figure 2:
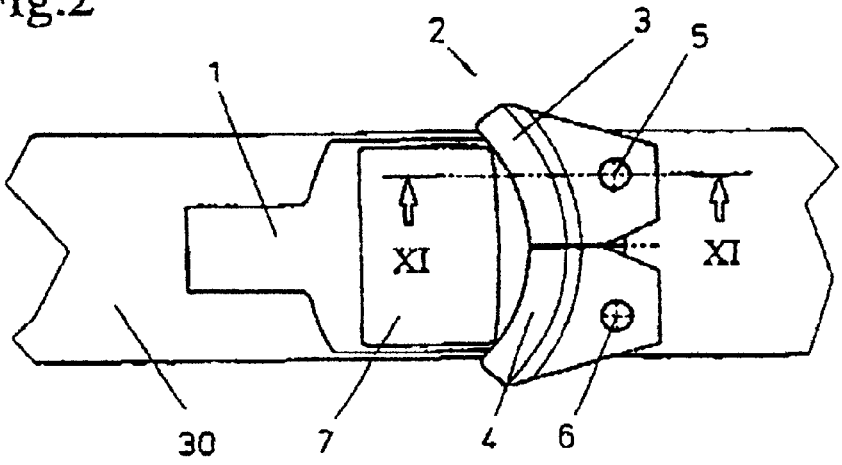
FIG. 2 is a plan view of this same stop.

The stop depicted in FIGS. 1 and 2 comprises a binding body 1 here fixed to a ski 30 and bearing a sole clamp 2 intended to retain a boot 27 by its sole 15 which for this purpose has a front curb 15*a* of standardized height. The binding body also carries a gliding plate 7 on which the sole of the boot rests. The sole clamp 2 is made up of two sole clamps 3 and 4 articulated respectively about a vertical axle 5, 6 on the body 1.

The terms front, rear and left, right are used looking toward the pointed end or tip of the ski.

Figure 3:
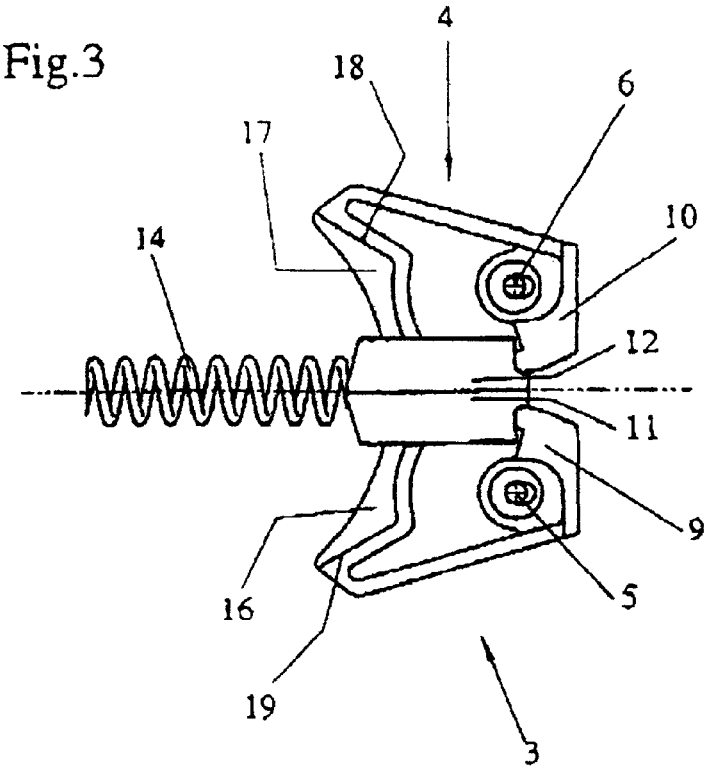
FIG. 3 is a view from beneath of the same stop, but without the binding body or the bearing plate.
Figure 5:
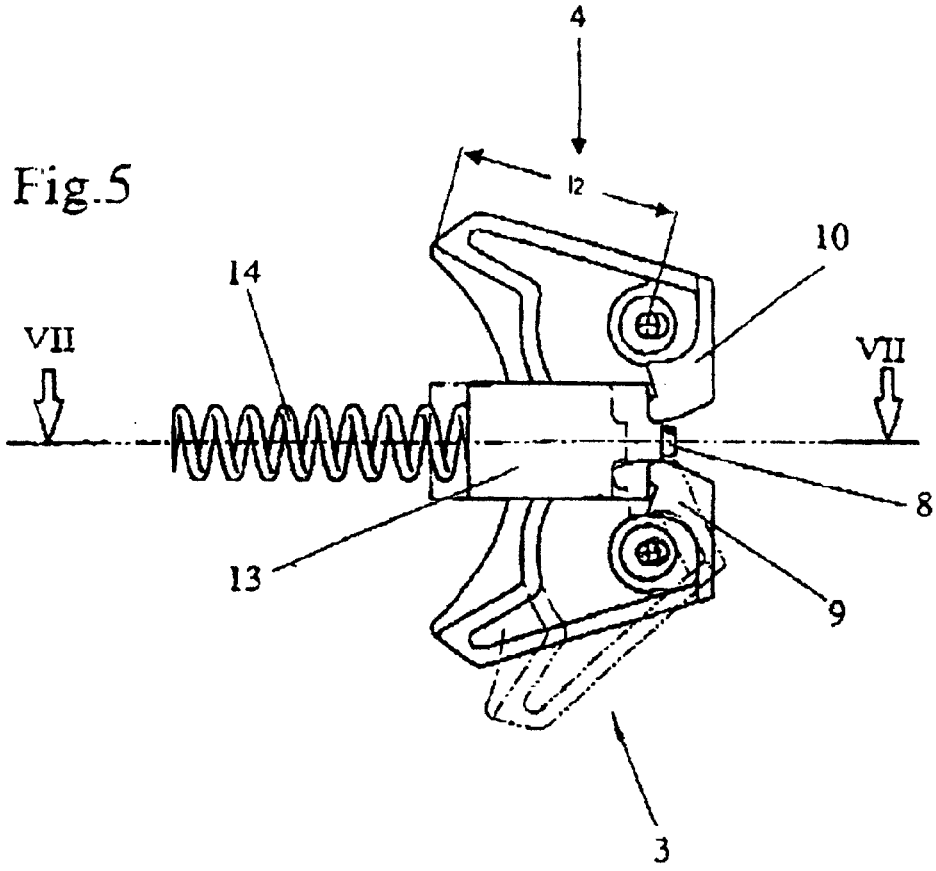
FIG. 5 is a view from beneath similar to FIG. 3 but with a one-piece piston and which, in chain line, shows the movement of one of the sole clamps and of the piston.

As can be seen in FIG. 3, each of the sole clamps 3 and 4 is in the form of a lever of the first kind, the longest lever arms of which diverge, while the shortest lever arms converge and are practically perpendicular to the longitudinal axis of the stop. The converging lever arms of the sole clamps 3 and 4 are each equipped with an approximately vertically descending arm 9 and 10 respectively, bearing on two parallel pistons 11 and 12 or, as a preference, one single common piston 13 (FIG. 5) subjected to the thrust of a precompressed spring 14. In a known way, the sole clamps 3 and 4 have vertical faces 19 and 19 intended to press laterally against the sole 15 of the boot, or each side thereof, and two horizontal faces 16 and 17 respectively, intended to press against the curb 15*a* of the boot.

Figure 4:
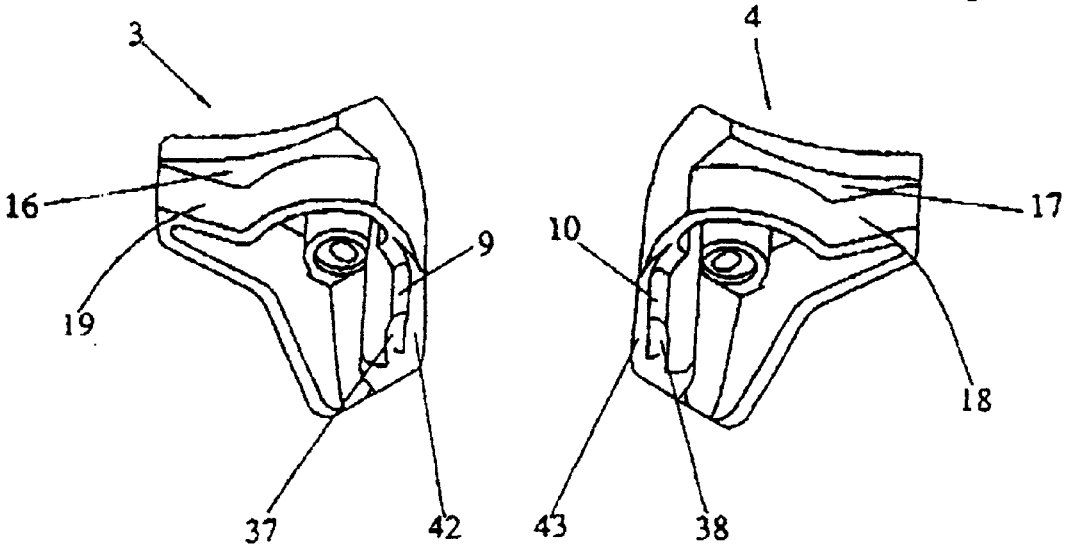
FIG. 4 is a view in perspective from beneath of the sole clamps of the jaw of this same stop.
Figure 6:
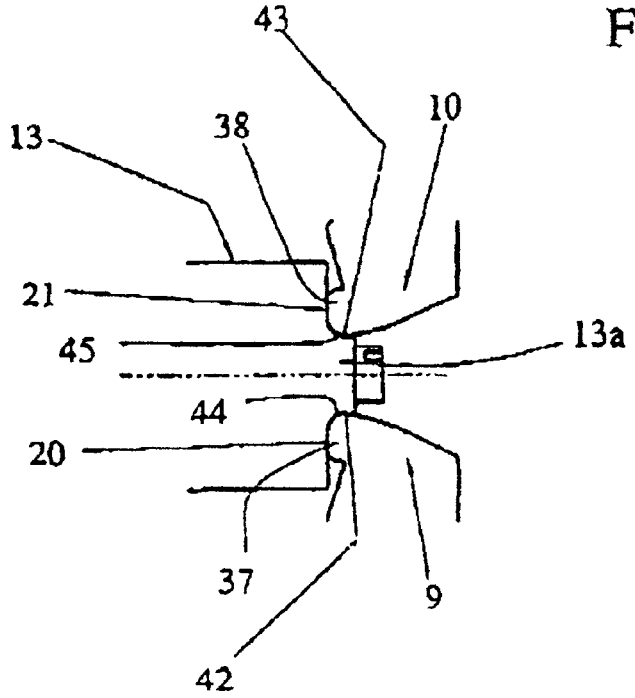
FIG. 6 is a detail of FIG. 5.

The descending arms 9 and 10 have, at their lower end, a respective boss 37 and 38 via which these arms 9 and 10 press against the end of the piston 13 or, respectively, the pistons 11 and 12. Hereinafter, reference will be made only to the piston 13. It can be seen that the points at which the bosses 37 and 38 bear against the piston are closely spaced and are close to the longitudinal axis of the piston. In the embodiment depicted in FIGS. 4 to 6, the piston 13 has a central frontal projection 13*a* forming two lateral bearing surfaces 44 and 45 against which the descending arms 9 and 10 are pressed via two lateral bearing surfaces 37 and 38. In the example depicted, the frontal bearing surfaces 20 and 21 of the piston are connected respectively to the lateral bearing surfaces 44 and 45 by a rounded portion and the same is true of the lateral bearing faces 42 and 43 of the sole clamp which are connected to the bearing bosses 37 and 38. As the sole clamps are mounted to tilt in a vertical plane, this configuration of the bearing portions against the piston prevents undesirable tilting of the arms of the jaw in an oblique vertical plane relative to the axis of the ski, which is something which could happen, particularly if walking around not properly clipped in to the stop.

Figure 7:
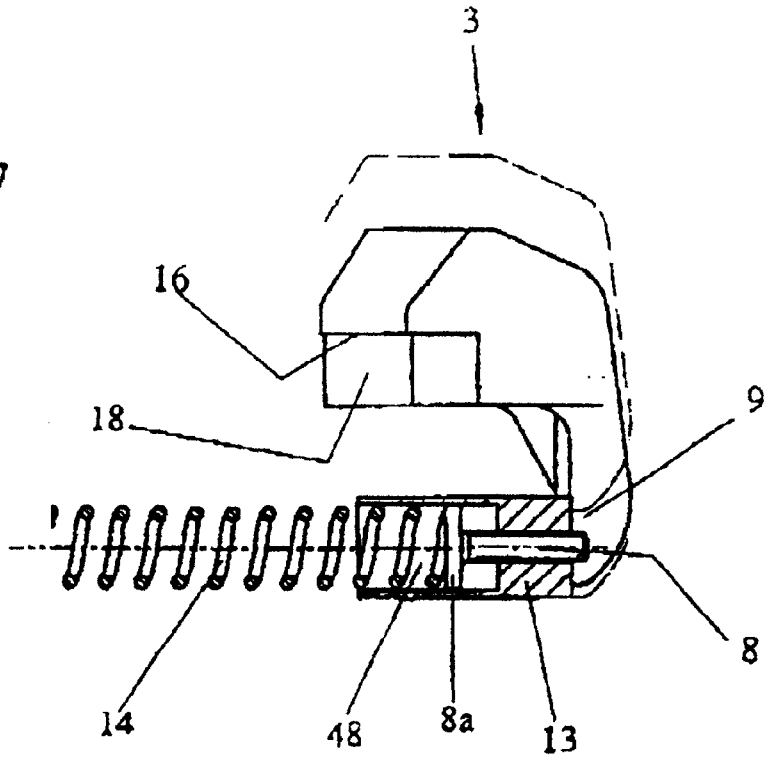
FIG. 7 is a view in section on VII—VII of FIG. 5.

As depicted in FIG. 7, the piston 13 advantageously has a bore 48 in which the spring 14 engages, which spring presses not against the closed end of the bore but against the disk 8*a* which moves as one in translation with a screw 8 passing through the closed end of the bore and allowing the precompression of the spring 14 and therefore the stiffness of the binding to be adjusted.

Figure 9:
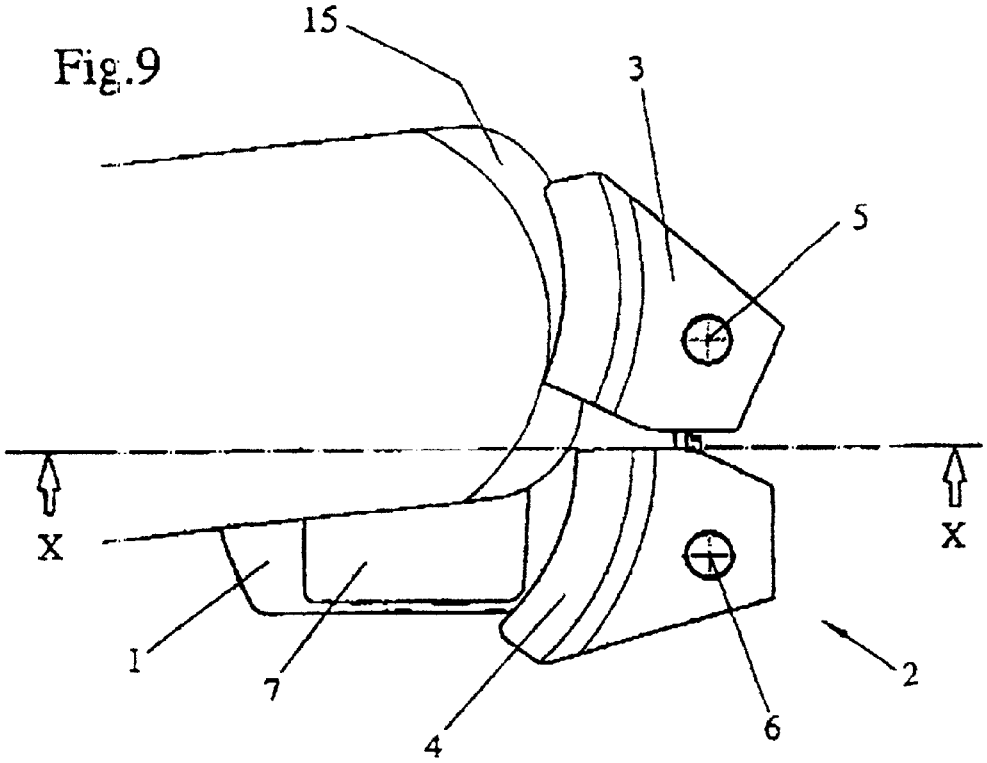
FIG. 9 is a plan view from above of the same stop in the lateral release position.

FIG. 9 depicts the front stop in the process of releasing to the left. The sole 15 of the boot is exerting lateral thrust on the sole clamp 3. This thrust is transmitted to the piston by the drive line that consists of the sole clamp 3, the descending arm 9 and the boss 37. In this case, the descending arm 9 merely has the sole function of pressing the shortest lever arm of the sole clamp 3 against the piston. As soon as the boot has left the stop, the spring 14, via the piston 13, returns the sole clamp 3 to its initial position.

Figure 11:
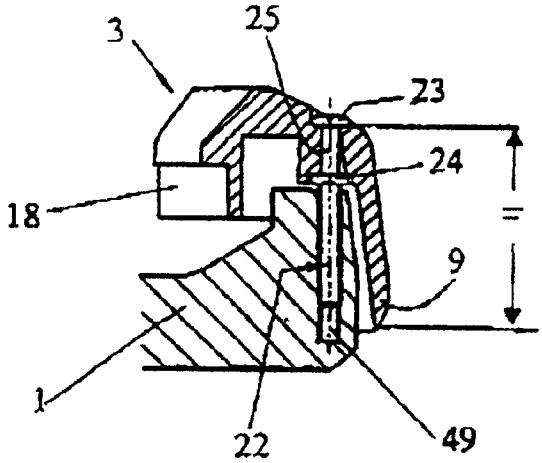
FIG. 11 is a view in section on XI—XI of FIG. 2.
Figure 12:
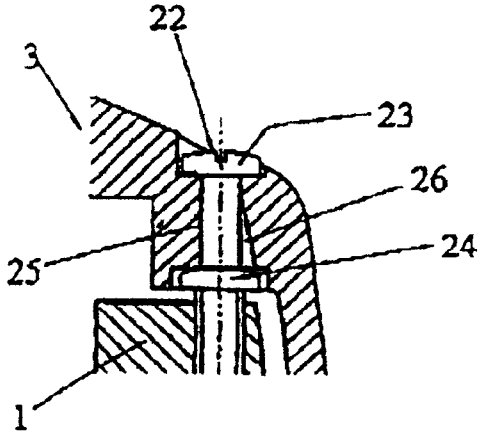
FIG. 12 is an enlarged view of a detail of FIG. 11.
Figure 13:
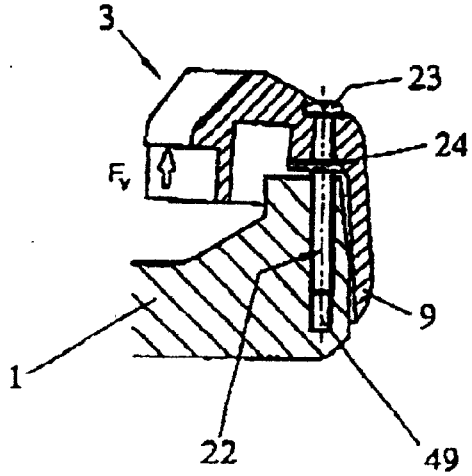
FIG. 13 is a view in section similar to FIG. 11, showing the sole clamp tilted under the effect of a force $F_v$.
Figure 14:
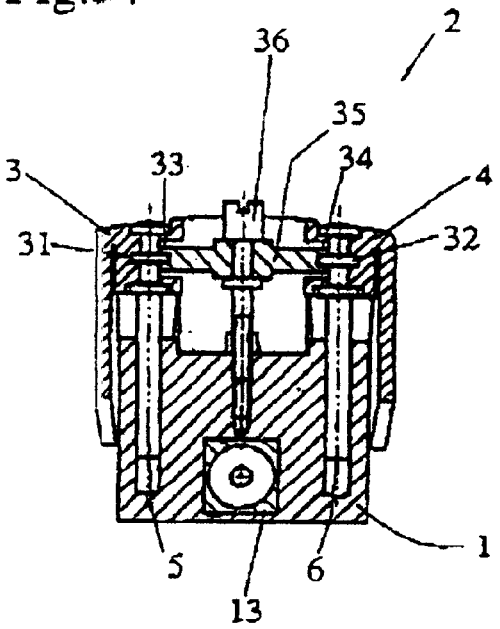
FIG. 14 is a view in cross section, from the rear to the front, at the pivot axles of the sole clamp, of a second embodiment.
Figure 15:
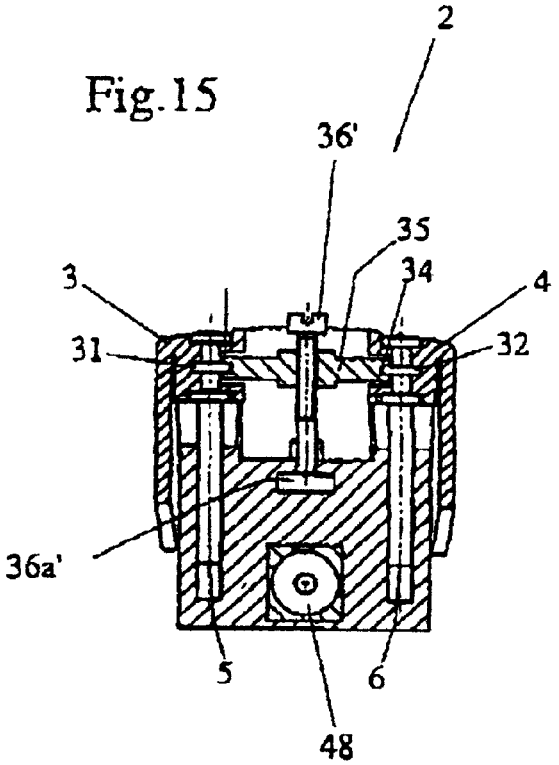
FIG. 15 depicts a variant of this second embodiment.
Figure 16:
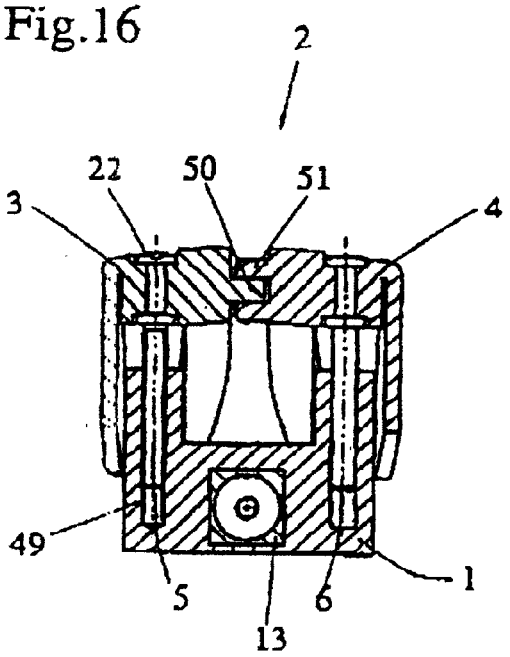
FIG. 16 depicts a second variant of the second embodiment.
Figure 21:
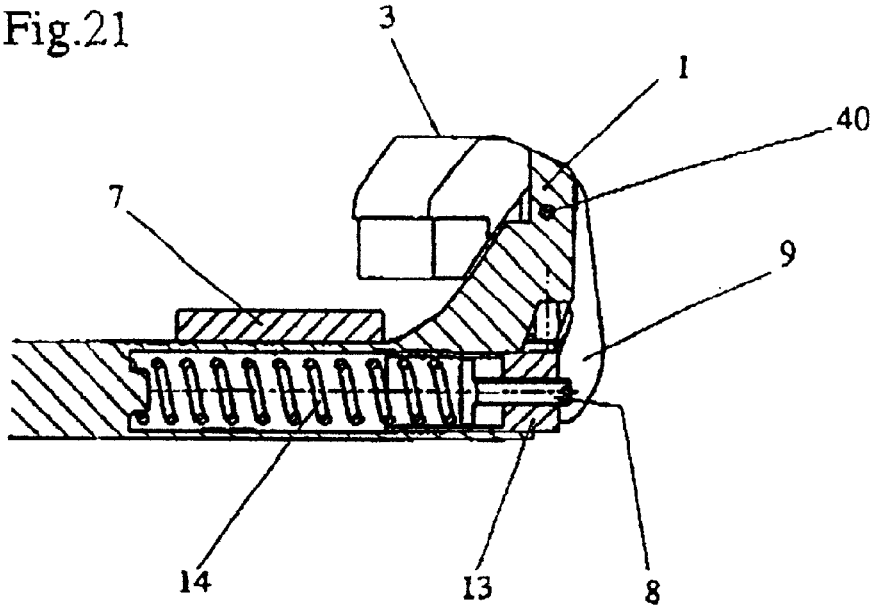
FIG. 21 is a view in axial section of the embodiment depicted in FIG. 17.
Figure 22:
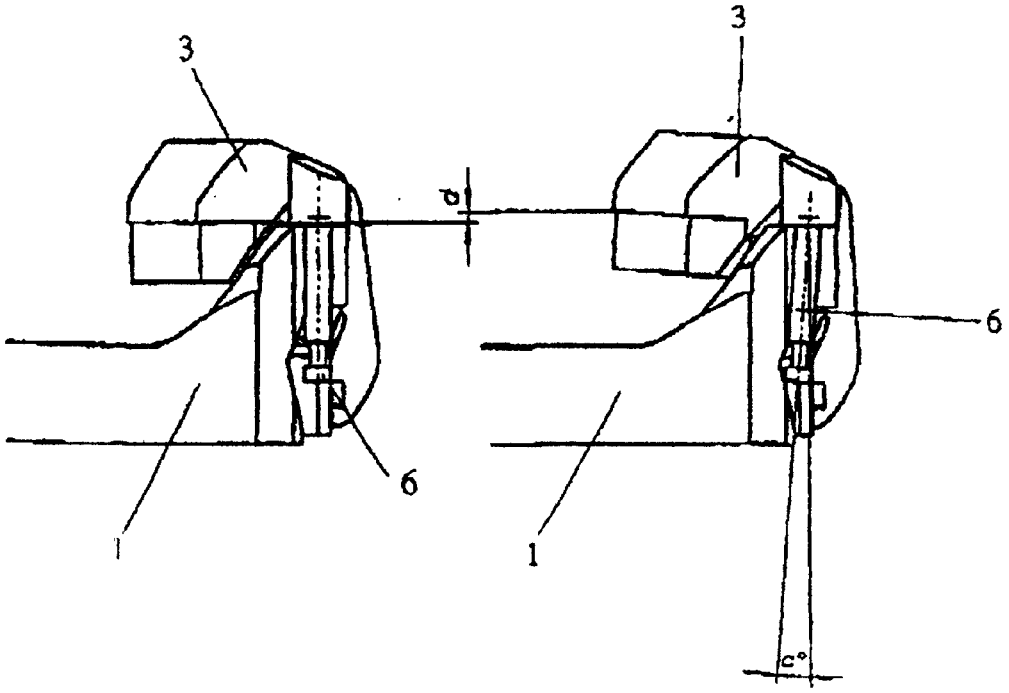
FIG. 22 is a lateral view of the same stop in two different positions of the sole clamp in the vertical plane.

In the embodiment depicted in FIGS. 11 to 13, and in its variants depicted in FIGS. 14 to 16, the height of the sole clamps relative to the binding body 1 can be altered. This is needed when the stop is used in a cross-country binding, as the boots used in cross-country skiing have soles which do not all have the same thickness.

In the embodiment depicted in FIGS. 11 to 13, each of the pivot axles 5 and 6 of the sole clamps has a threaded part 22 engaged in a tapped hole 49 in the body 1 find the upper end of the axle is fitted with a screw head 23. This head 23 also constitutes a first stop for axially retaining the sole clamp, the axles 5 and 6 having a second stop consisting of a bearing surface 24 of the axle, against which bearing surface the sole clamp rests. Furthermore, the passage 25 of the axle through the sole clamp has a section which is increasingly ovalized toward the front, dropping down in the direction of the longitudinal axis of the binding so as to create an angular clearance 26 in a vertical plane parallel to the longitudinal axis of the binding. Clearance is also provided in the sole clamps in front of and behind the bearing surface 24 and the upper face of this bearing surface 24 is inclined on its front part and on its rear part so as to allow the sole clamp to tilt in a vertical plane. The length of the part 25 of the pivot axle between the stops 23 and 24 is preferably at least equal to twice the diameter of this part 25. This ratio proves to be particularly good at restricting the required freedom of tilting of the sole clamps to the desired value.

In order to have a harmonious relationship between the resistive torques of lateral retention and of tilting in a vertical plane, the distance 11 (FIG. 11) between the imaginary axis of rotation of the sole clamps in a vertical plane and the end of the points at which the descending arms bear on the piston is advantageously approximately equal to the length 12 (FIG. 5) of the diverging lever arms of the sole clamps.

FIG. 13 illustrates the tilting of one of the sole clamps under the effect of a force $F_v$ directed upward, for example in the event of a forward fall or backward fall. It may be seen that the sole clamp can tilt elastically on its pivot axle by virtue of the clearance 26 and of the piston 13.

In the embodiment depicted in FIG. 14, the two threaded axles 5 and 6 according to 22 are replaced with two axles 5 and 6 mounted to slide in the body 1 and connected together by a cross member 35, the grooved ends of which are in engagement with bearing surfaces or collars 31 and 32 of the axles 5 and 6. The cross member 35 is itself carried by a screw 36 screwed into the body 1 and allowing the height of the sole clamps to be adjusted relative to the body 1.

In the variant depicted in FIG. 15, the screw 36 is replaced by a screw 36' the thread of which is engaged in a tapped hole in the cross member 35, while the lower end 36'*a* of this screw 36' simply has a widening via which the screw is axially retained in the body 1 while being able to rotate therein with a significant amount of friction.

In the variant depicted in FIG. 16, the sole clamps 3 and 4 are connected directly together by a kind of tenon and mortise assembly 50, 51 acting as the cross member of FIGS. 14 and 15. Heightwise adjustment is by means of the threaded axle 5 as before, while the axle 6 simply slides in the binding body.

Figure 8:
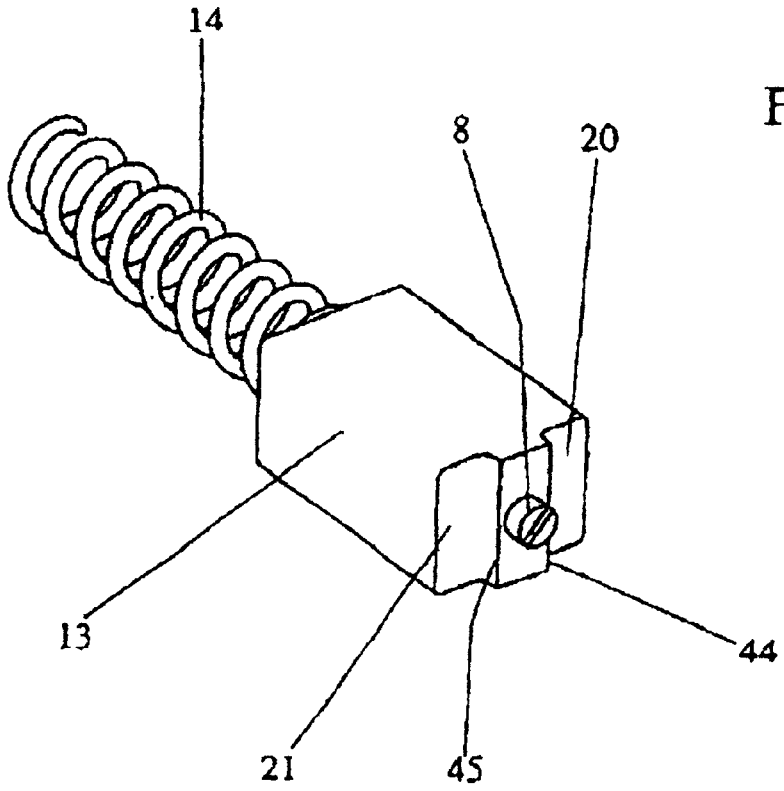
FIG. 8 is a perspective view of the piston and of its spring.
Figure 10:
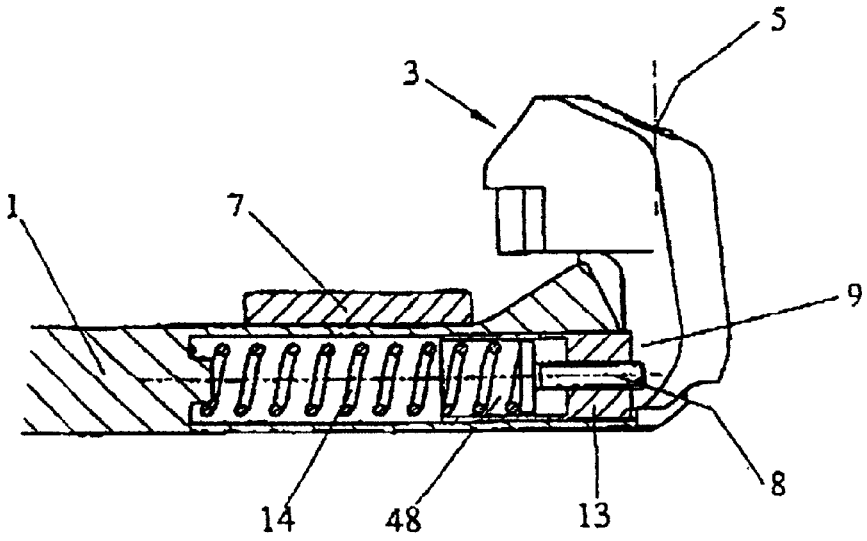
FIG. 10 is a view in section on X—X of FIG. 9.

As can be seen in FIGS. 7, 8 and 10, the frontal face of the piston 13 is vertical, that is to say perpendicular to the plane of the binding, which means that the lever ratios are the same for all levels of heightwise adjustment of the sole clamps, which guarantees uniform release throughout the range of heightwise adjustment.

In the embodiment depicted in FIGS. 17 to 25, the pivot axles 5 and 6 are connected together by a cross member 40 so as to form a sole clamp carrier 41 made as a U-shaped single piece, the branches of which diverge slightly as is particularly visible in FIG. 24. The axles 5 and 6 make an angle of a few degrees between them. The sole clamp carrier 41 is supported by a frontal part 1*a* of the binding body so as to pivot about an axis consisting of the horizontal part 40 of the sole clamp carrier. The only degree of freedom of the sole clamps 3 and 4 on the sole clamp carrier 41 is a movement of rotation about the axles 5 and 6. As the sole clamps tilt in a vertical plane, the sole clamp carrier 41 is therefore carried along in this movement.

Because of the oblique angle of the pivot axles 5 and 6, when one of the sole clamps pivots under the effect of the lateral thrust of the boot, the sole clamp, for example, the sole clamp 4 in FIGS. 23 and 25, turns in an upward oblique plane, which has the effect of making it easier for the boot to escape by moving the bearing face 17 of the sole away. This elevation of the sole clamp is depicted as e in FIG. 23.

Figure 26:
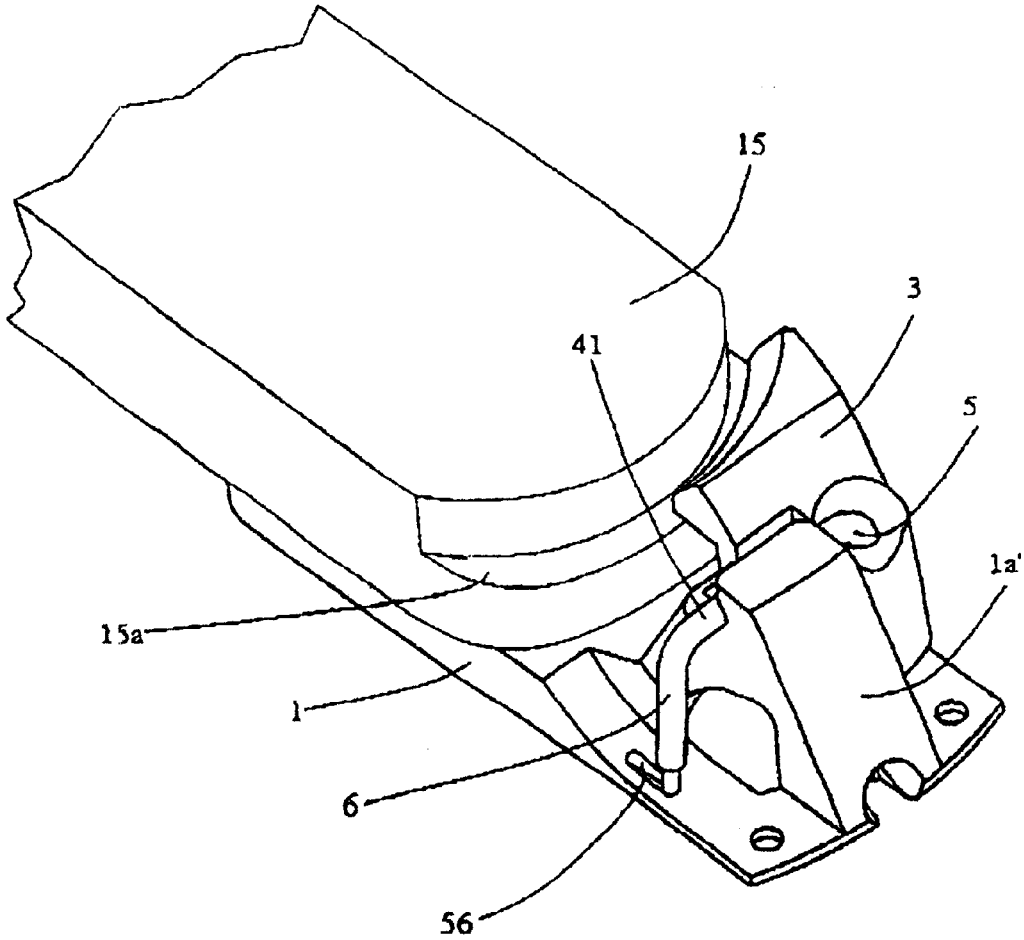
FIG. 26 is a view from above, in perspective, of a variant of the third embodiment, without the sole clamp.
Figure 27:
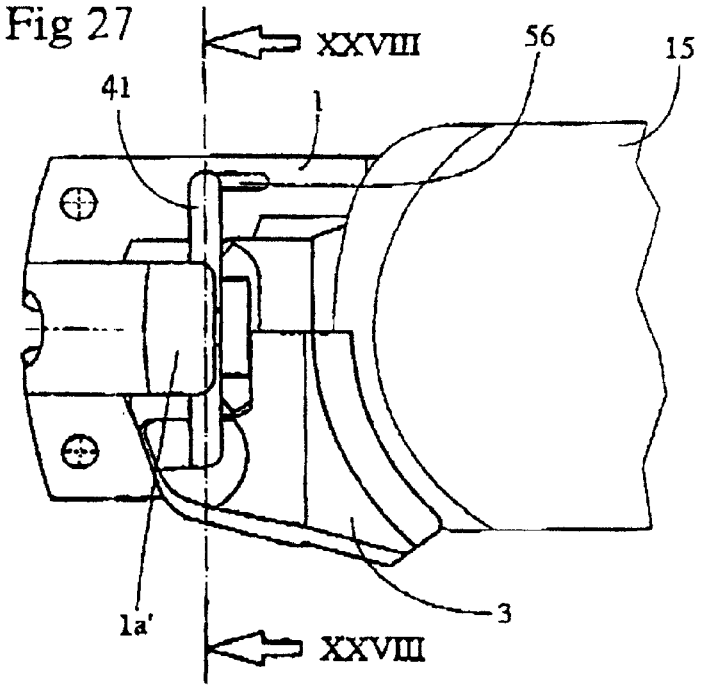
FIG. 27 is a view from above of the same variant, also without the sole clamp.
Figure 28:
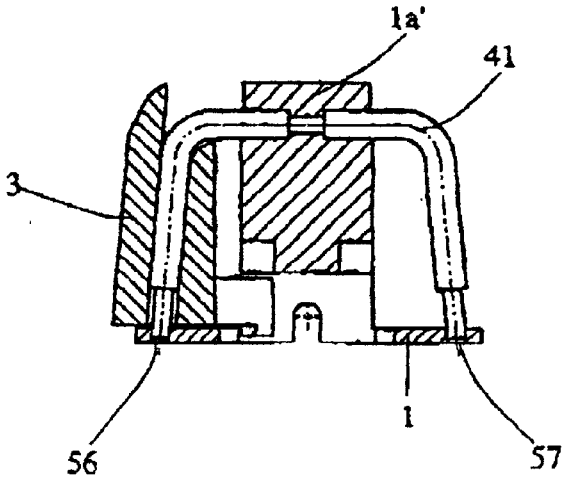
FIG. 28 is a view in section on XXVIII—XXVIII of FIG. 27.

An improvement to this last embodiment is depicted in FIGS. 26 to 28. We again see the sole clamp carrier 41 mounted to pivot about a horizontal axle via its transverse part on a base 1*a*' of the binding body 1. The lower ends of the axles 5 and 6 are engaged respectively in slots 56, 57 formed in the binding body 1. These slots 56 and 57 are oriented parallel to the longitudinal axis of the binding and have the effect of limiting the tilting of the sole clamp carrier 41 and, therefore, of limiting the tilting of the sole clamp carrier in a vertical plane and of preventing parasitic sideways movement.

In contrast to what happens in the embodiments 11 to 16, in which the sole clamps 3 and 4 can tilt independently of one another in a vertical plane, in the embodiments with sole clamp carrier 41, the tilting of one of the sole clamps causes the other sole clamp to tilt.

It would of course be possible to have a possibility for heightwise adjustment by mounting the sole clamp carrier 41 on a height-adjustable component.

FIG. 29 illustrates another solution for reducing the fraction of the sole clamps on the boot when tie stop is released. For this purpose, the binding body 1 has, on the boot side, two vertical guide surfaces 52 and 53 which are symmetric relative to the axis of the stop. These guide surfaces act as cams against which a respective one of two vertical fingers 54 and 55 of the sole clamps 3 and 4 bear, the surfaces 52 and 53 being shaped in such a way that when a sole clamp pivots in its direction of release, it simultaneously tilts in a vertical plane so as to move away from the curb of the boot. The fingers 54 and 55 could be replaced by any other gliding surface. This improvement has been depicted for one embodiment according to FIGS. 11 to 13 but could also be used in the embodiment according to 17 to 28, whether that be with oblique pivot axles or vertical pivot axles.

The stop may advantageously be fitted with a cap 47 (FIG. 30) at least partially covering the sole clamps 3 and 4, so that the stop is protected against the ingress of snow and ice.

Finally, the body 1 of the stop may be articulated about a transverse axle 28 on a stirrup 29, as depicted in FIGS. 31 and 32, in a cross-country binding. In this case, the binding body 1 is secured to a plate or a bar which, at the rear, carries a heel piece for holding the heel of the boot, as is known, for example, from U.S. Pat. No. 5,735,541.

As has already been mentioned, the binding according to the invention could be a heel piece, that is to say intended to secure the rear of the boot.

Instead of a piston pushed by a spring or two springs of smaller diameter in order to reduce the height of the support plate, use could be made of any other device consisting of a moving element urged elastically by a spring or any other elastic means, possibly pneumatic. The moving element does not necessarily have to move axially, but could rotate.

Although illustrative embodiments of the invention have been shown and described, a wide range of modification, change and substitution is contemplated in the foregoing disclosure and in some instances, some features of the present invention may be employed without a corresponding use of the other features. Accordingly, it is appropriate that the appended claims be construed broadly and in a manner consistent with the scope of the invention.

What is claimed is:

1. A safety binding for a ski boot having a sole having opposite ends, the sole having a flange, the binding comprising a binding body having a horizontal sole interface for the boot to rest on extending vertically underneath the sole interface, the horizontal part underneath the sole interface containing a moving clement and an elastic means which urges the moving element in a outwardly extending direction away from a central region of the binding, the body supporting two sole clamps for holding the boot by the sole flange, these sole clamps each being mounted to pivot about an approximately vertical pivot axle to permit release of the boot and pivoting through a limited angle in a vertical plane about a real or imaginary axis located in the region where the boot is held by the sole clamp, each sole clamp comprising one descending arm rigidly and non-pivotably connected thereto and the ends of which bear against said moving element, wherein these sole clamps constitute two levers having two divergent lever arms, the two divergent lever arms each having a length associated therewith, the lever arms for retaining the boot laterally and two converging arms at least approximately perpendicular to a longitudinal axis of the binding, the lever arms defining a jaw, and bearing respectively against an end of the moving element via a descending arm at two closely spaced points.

2. The binding as claimed in claim 1, wherein the vertical axis of the sole clamp and the points at which the descending arms bear on the moving element define a distance approximately equal to the length of the diverging lever arms.

3. The binding as claimed in claim 2, wherein the pivot axles of the sole clamps about a vertical axis have two axial stops retaining the sole clamps vertically and in that the sole clamps have, between these stops, forward angular clearance allowing the sole clamps to tilt in a vertical plane.

4. The binding as claimed in claim 2, wherein the pivot axles of the sole clamps about an approximately vertical axis are connected without clearance to the sole clamps and are connected together rigidly at their upper part by a horizontal part so as to form a single U-shaped component mounted to pivot, between two stops, about its horizontal transverse part.

5. The binding as claimed in claim 1, wherein the pivot axles of the sole clamps has two axial stops having bodies, the stops retaining the sole clamps vertically and in that the sole clamps have, between these stops, forward angular clearance allowing the sole clamps to tilt in a vertical plane.

6. The binding as claimed in claim 5, wherein the pivot axles are comprised of screws screwed into the body of the stop for heightwise adjustment of the sole clamps.

7. The binding as claimed in claim 5, wherein the pivot axles are mounted to slide in the body of the stop and are connected together at their upper part by a cross member supported at its central part by a threaded rod for adjusting the height of the cross member.

8. The binding as claimed in claim 5, wherein the sole clamps are secured together in terms of vertical movement and in that one of the pivot axles comprises a screw screwed into the body and the other axle can slide in the body.

9. The binding as claimed in claim 1, wherein the pivot axles of the sole clamps about an approximately vertical axis are connected without clearance to the sole clamps and are connected together rigidly at their upper part by a horizontal part so as to form a single U-shaped component having branches mounted to pivot, between two stops, about its horizontal transverse part.

10. The binding as claimed in claim 9, wherein the binding body has two slots through vhich the pivot axles pass, the ends of these slots constituting said stops.

11. The binding as claimed in claim 9, wherein the branches of the U-shaped component diverge slightly so that the pivot axles are inclined slightly sideways so that sole clamps, as they open, move slightly upward.

12. The binding of claim 1 wherein the pivot axles are co-axial.

13. The binding as in claims 1 to 12, wherein the moving element is a piston having a frontal projection forming two lateral bearing surfaces for the ends of the descending arms.

14. The binding as in claims 1 to 12, wherein the binding body has guide surfaces against which gliding surfaces of the sole clamps bear, these guide surfaces having a shape such that they cause the sole clamps to tilt gradually as they pivot.

15. The binding as claimed in claim 14, wherein the gliding surfaces are surfaces of two vertical fingers.

16. The binding as in claims 1 to 12, to wherein the moving element is equipped with an adjusting screw for adjusting a precompression of the elastic means.

17. The binding as in claims 11 to 12, wherein the binding is a stop having a body mounted to pivot about a transverse horizontal axle in a stirrup.

18. The binding as in claims 1 to 12, wherein the moving element is split into two pistons one pressing respectively on each of the two sole clamps.

19. The binding as in claims 1 to 12, wherein the angle of pivoting of the sole clamps in a vertical plane is great enough to release the boot in a backward fall or to produce a heel piece.

* * * * *